US006331087B1

(12) United States Patent
Wang

(10) Patent No.: US 6,331,087 B1
(45) Date of Patent: Dec. 18, 2001

(54) COMBINATION PEN AND TOOL ARRANGEMENT

(76) Inventor: Chen-Shan Wang, 1F. No. 13, Alley 15, Lane 22, Hwalin Street, Shihlin District, Taipei (TW)

( * ) Notice: Subject to any disclaimer, the term of this patent is extended or adjusted under 35 U.S.C. 154(b) by 0 days.

(21) Appl. No.: 09/783,016

(22) Filed: Feb. 15, 2001

(51) Int. Cl.[7] ..... B43K 29/18; B26B 11/00
(52) U.S. Cl. ..... 401/195; 7/118; 7/158; 7/162; 30/146; D19/36
(58) Field of Search ..... 401/195, 52; 30/146; 7/118, 162, 158; D19/36

(56) References Cited

U.S. PATENT DOCUMENTS

D. 129,368 * 9/1941 Cummings ..... D19/36 X
D. 137,339 * 2/1944 Liukko ..... D19/36 X
238,023 * 2/1881 Bramberg ..... 401/195 X
D. 302,174 * 7/1989 Coburn ..... D19/36
D. 436,126 * 1/2001 Rosenbaum ..... D19/36
3,706,106 * 12/1972 Leopoldi ..... 401/195 X
5,653,525 * 8/1997 Park ..... 7/118 X

* cited by examiner

*Primary Examiner*—Gregory L. Huson
*Assistant Examiner*—Kathleen J. Prunner
(74) *Attorney, Agent, or Firm*—Varndell & Varndell, PLLC

(57) ABSTRACT

A combined pen and tool arrangement includes a lower penholder holding an ink cartridge for writing, an upper penholder fastened to the lower penholder, and a tool holder mounted inside the upper penholder and holding a pair of scissors and a cutter. The scissors and the cutter are respectively turned in and out of the tool holder and the upper penholder through a longitudinal slot in the tool holder and a longitudinal slot in the upper penholder.

6 Claims, 12 Drawing Sheets

COMBINATION PEN AND TOOL ARRANGEMENT

BACKGROUND AND SUMMARY OF THE INVENTION

The present invention relates to writing apparatus and, more specifically, to a combination pen and tool arrangement in which a pair of scissors and a cutter are mounted in the upper penholder of a pen and turned between an extended position and a received position.

Conventional writing apparatus are simply designed for writing. In addition to writing apparatus, a scissors and/or cutter may be used when doing paper work. In order to keep writing materials in good order, desktop storage means may be needed. It is desirable to combine a writing apparatus and a tool or tools into a combination device, so as to provide the writing apparatus with added functions.

The present invention provides a combination pen and tool arrangement, which combines a pen and two small tools together. According to the present invention, the combination pen and tool arrangement comprises a pen, and a tool holder mounted inside the upper penholder of the pen. The tool holder holds two small tools, for example, one pair of scissors and a cutter. The scissors and the cutter are pivoted to the tool holder, and can be respectively turned in and out of the tool holder and the upper penholder through a longitudinal slot of the tool holder and a longitudinal slot of the upper penholder.

BRIEF DESCRIPTION OF THF DRAWINGS

DETAILED DESCRIPTION OF THE PREFERRED EMBODIMENT

Figure 1:
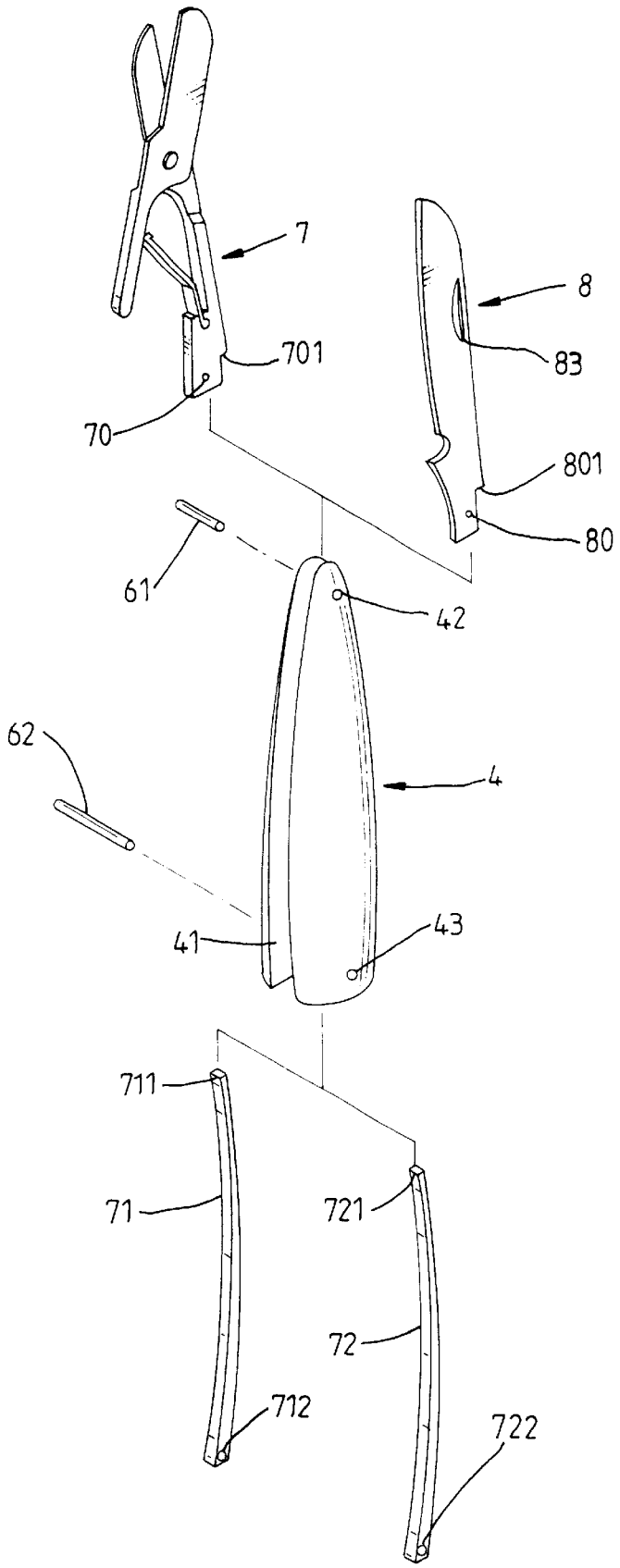
FIG. 1 is an exploded view of a tool holder unit for a combination pen and tool arrangement according to the present invention.
Figure 2:
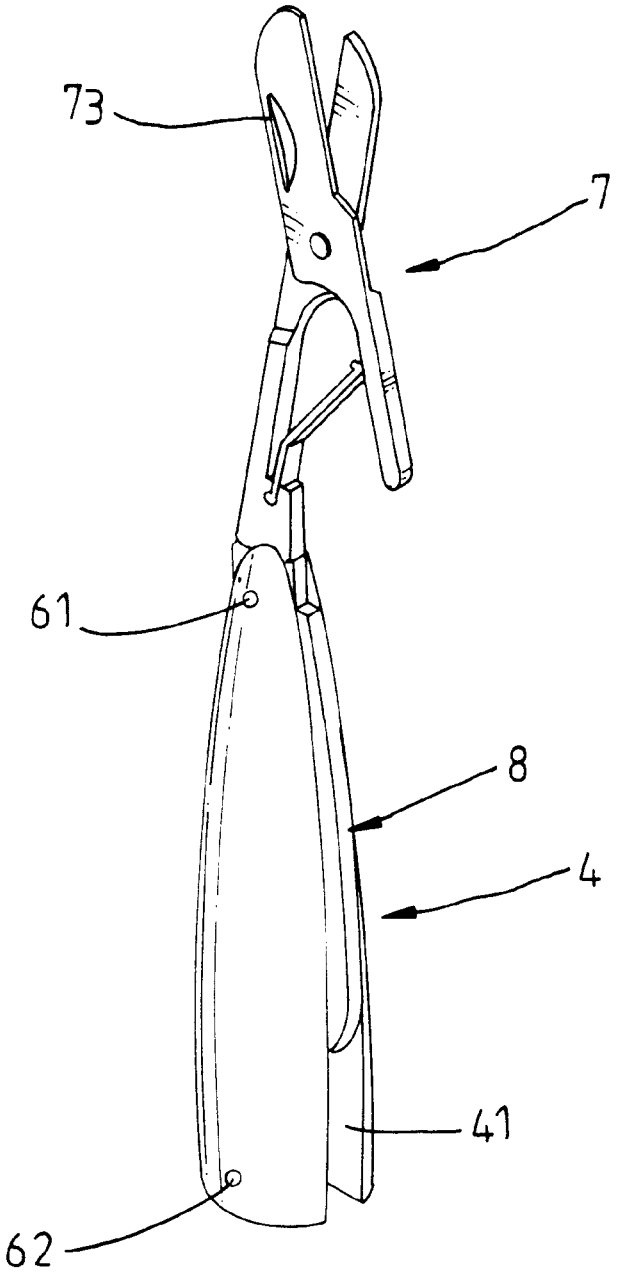
FIG. 2 is an elevational view of the tool holder unit according to the present invention, showing the scissors extended out of the tool holder.
Figure 3:
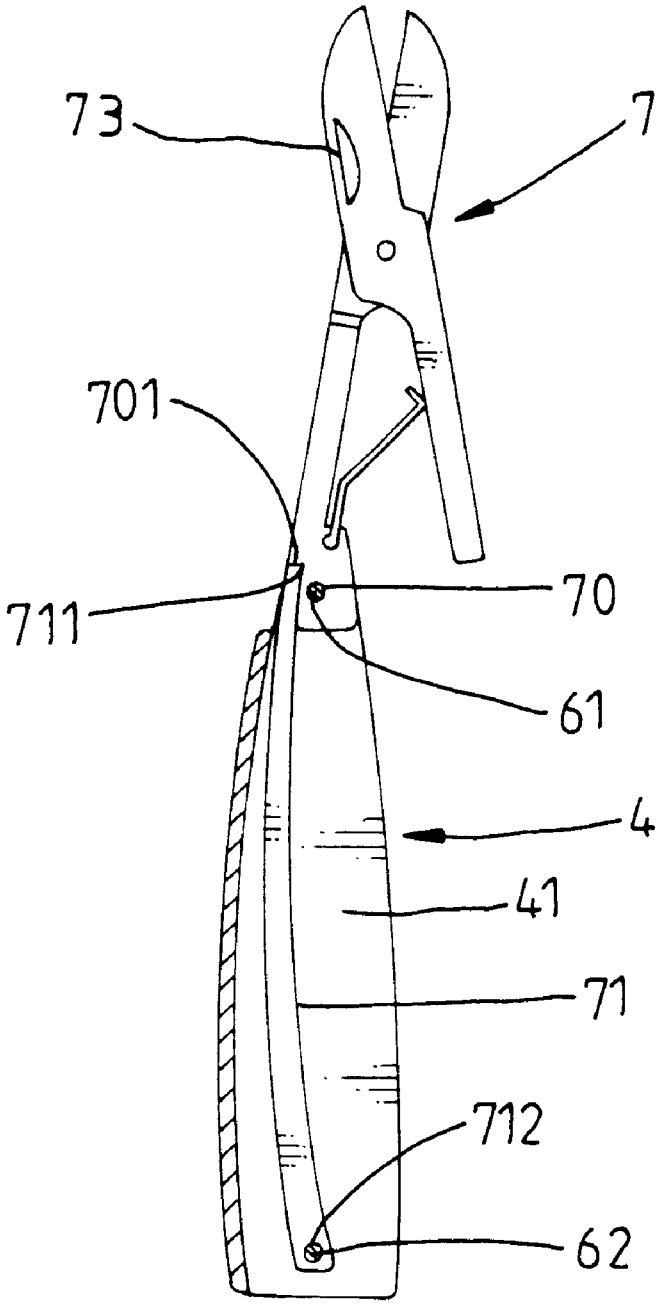
FIG. 3 is a sectional view of the tool holder unit according to the present invention, showing the scissors extended out of the tool holder.
Figure 4:
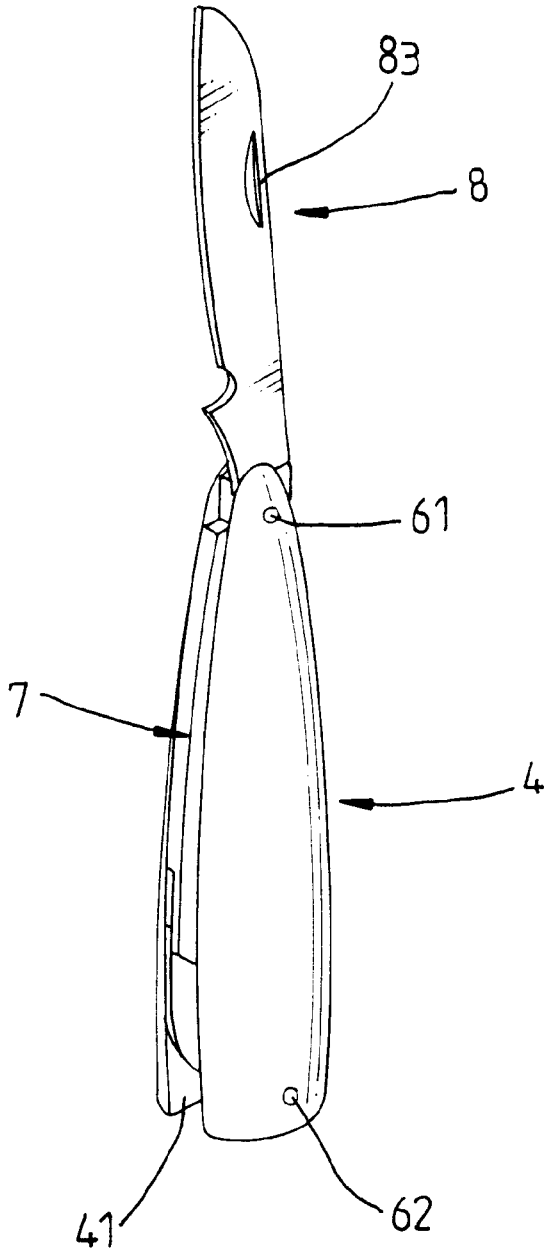
FIG. 4 is another elevational view of the tool holder unit according to the present invention, showing the cutter extended out of the tool holder.
Figure 5:
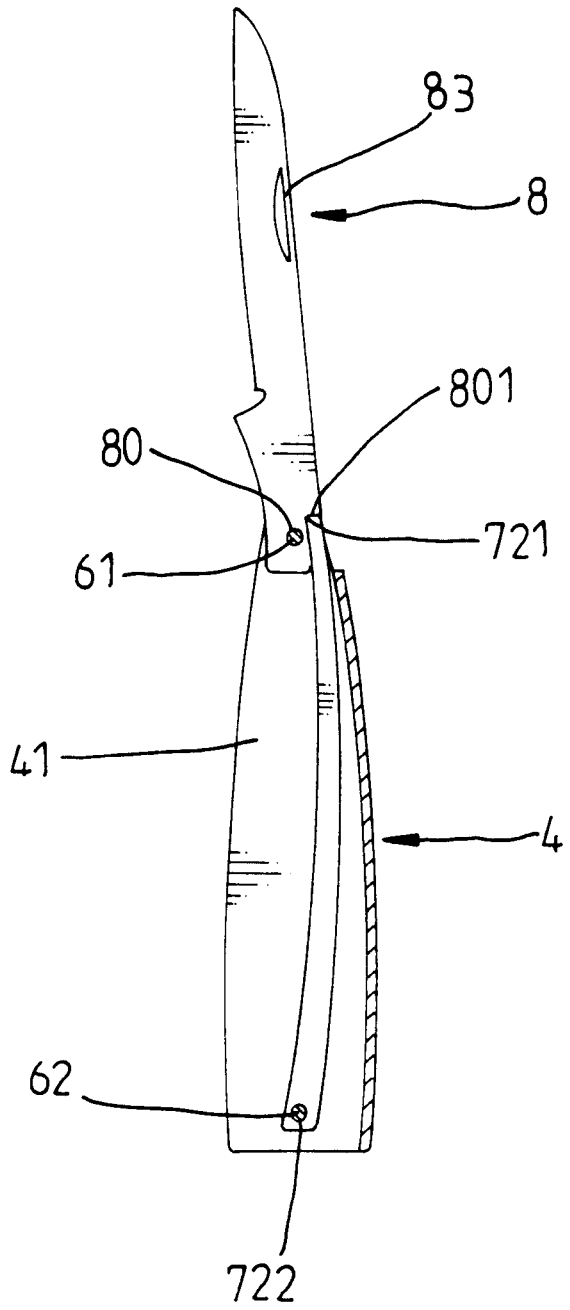
FIG. 5 is another sectional view of the tool holder unit according to the present invention, showing the cutter extended out of the tool holder.

Referring to FIGS from 1 through 10, a combination pen and tool arrangement in accordance with the present invention is generally comprised of an upper penholder 1, a lower penholder 2, an ink cartridge 3, a ink cartridge holder cap 5, a binding ring 52, a first spring rod 71, a second spring rod 72, and a tool holder and tool unit, which comprises a tool holder 4 and two tools, for example, a pair of scissors 7 and a cutter 8.

Referring to FIGS. from 1 through 10 again, the ink cartridge holder cap 5 comprises a bottom extension socket 53 press-fitted into the top end of the lower penholder 2 to hold the ink cartridge 3 inside the lower penholder 2, and a head 51 stopped at the top end of the lower penholder 2. The bottom extension socket 53 of the ink cartridge holder cap 5 defines a coupling hole 531. The ink cartridge 3 is fastened to the coupling hole 531 of the ink cartridge holder cap 5 and suspended in the lower penholder 2, having a writing tip 31 extended out of the tapered bottom end of the lower penholder 2 for writing. The upper penholder 1 is a hollow cylindrical shell mounted on the head 51 of the ink cartridge holder cap 5 to hold the tool holder 4 on the inside, and having a longitudinal slot 11. The tool holder 4 is injection-molded from plastics is inserted into the upper penholder 1, has a longitudinal slot 41 corresponding to the longitudinal slot 11 of the upper penholder 1, has a top through hole 42 transversely disposed near the top end thereof in communication with the longitudinal slot 41, and has a bottom through hole 43 transversely disposed near the bottom end thereof in communication with the longitudinal slot 41. The spring rods 71 and 72 each have a pinhole 712, 722, respectively, transversely disposed at the respective bottom end. The scissors 7 has a pivot hole 70 (at the bottom end of one blade thereof), a positioning notch 701 (on the same blade adjacent to the pivot hole 70), and a finger groove 73 (on the other blade thereof) remote from the pivot hole 70. The cutter 8 has a pivot hole 80 at the bottom end, a positioning notch 801 adjacent to the pivot hole 80, and a finger groove 83 remote from the positioning notch 801. A first pivot 61 is inserted through the pivot hole 70 of the scissors 7 and the pivot hole 80 of the cutter 8 and fastened to the top through hole 42 of the tool holder 4 to secure the scissors 7 and the cutter 8 to the tool holder 4. A second pivot 62 is inserted through the pin hole 712 of the first spring rod 71 and the pin hole 722 of the second spring rod 72 and fastened to the bottom through hole 43 of the tool holder 4 to secure the spring rods 71 and 72 in the tool holder 4, keeping the top end 711 of the first spring rod 71 and the top end 721 of the second spring rod 72 retained between the first pivot 61 and the inside wall of the tool holder 4.

Figure 6:
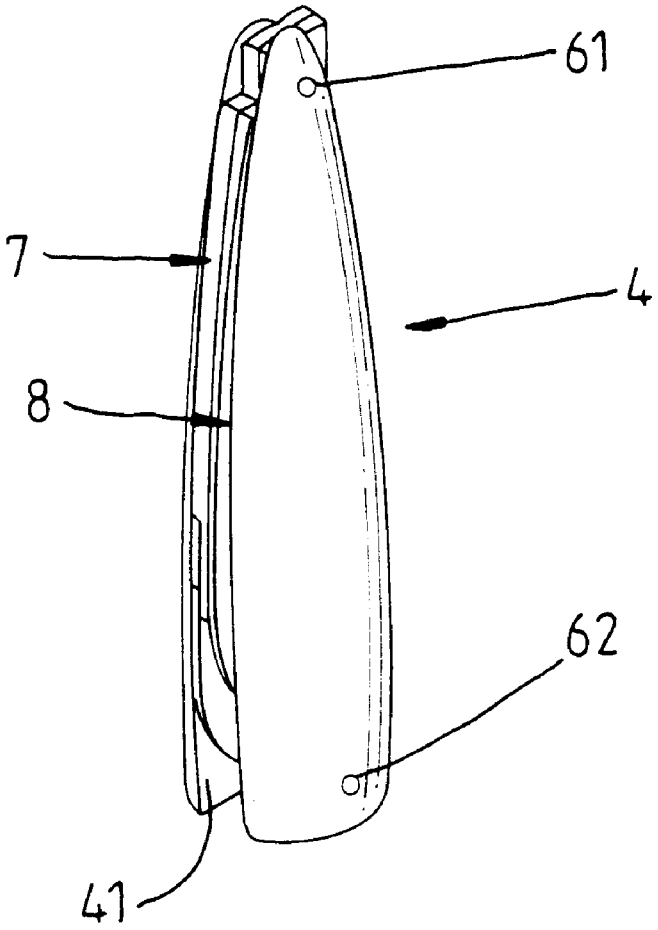
FIG. 6 is still another elevational view of the tool holder unit according to the present invention, showing the scissors and the cutter received in the tool holder.
Figure 7:
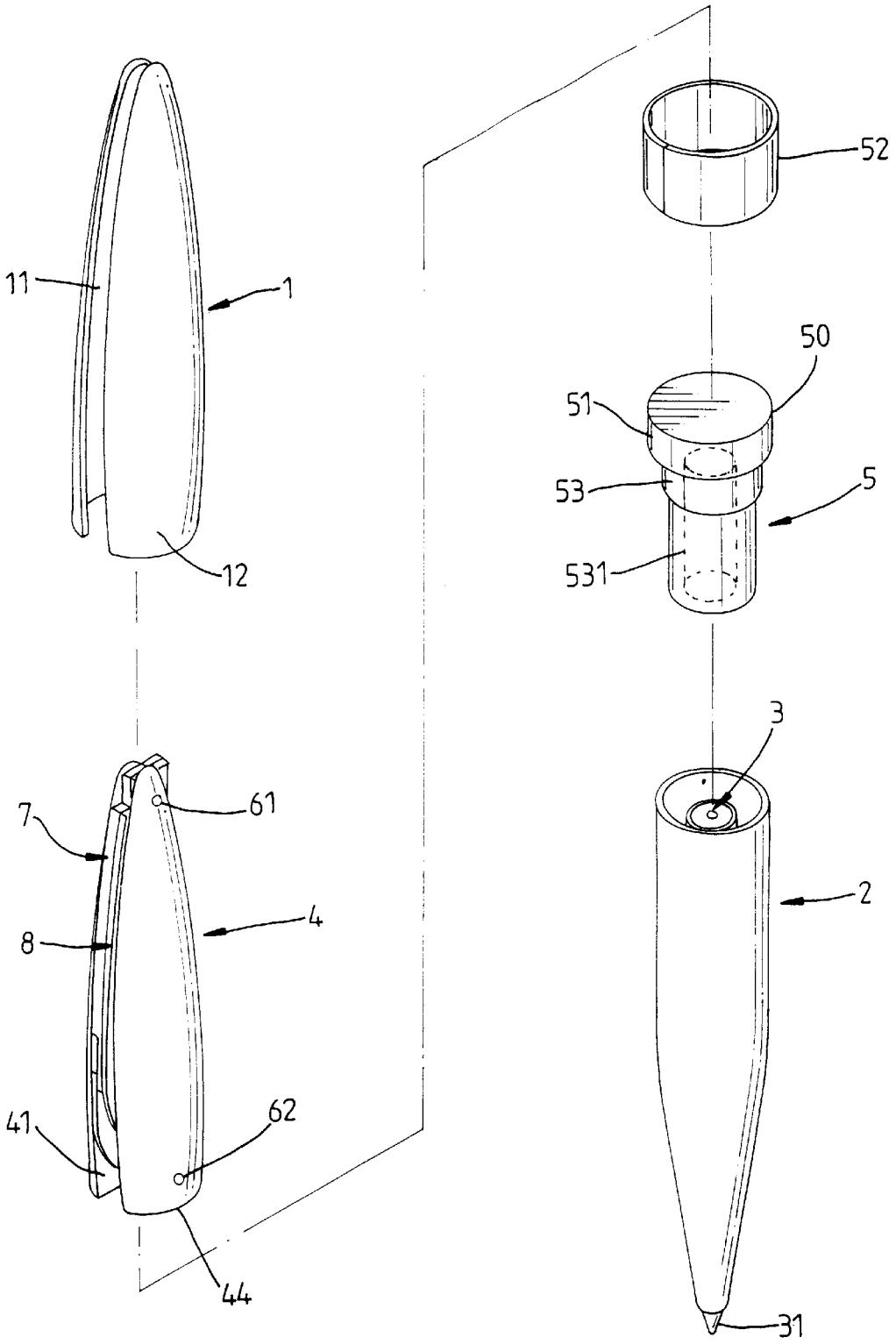
FIG. 7 is an exploded view of the combination pen and tool arrangement according to the present invention.
Figure 8:
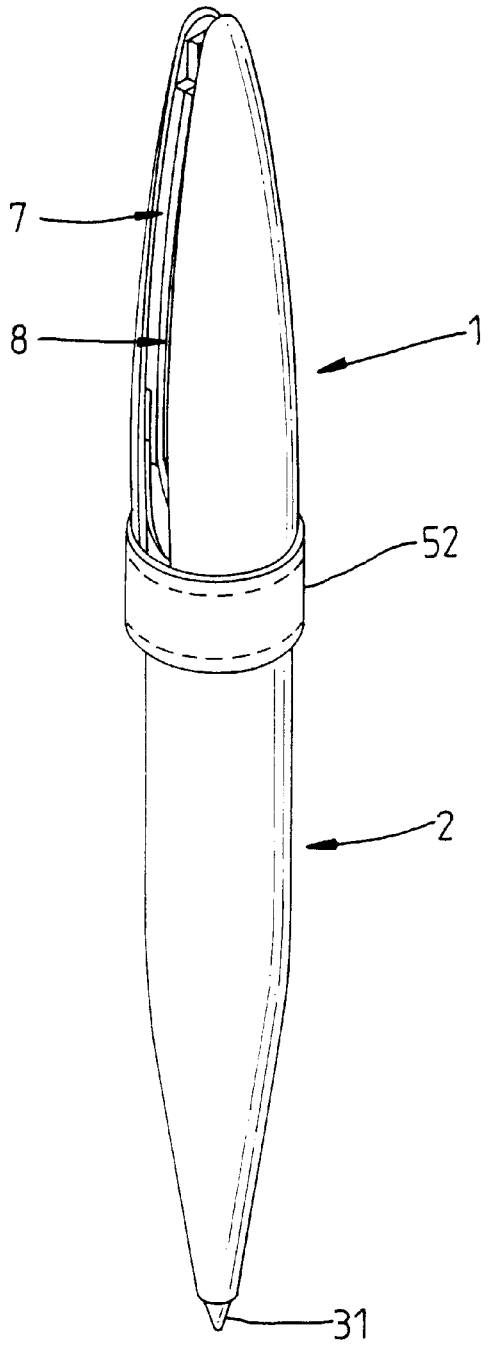
FIG. 8 is an elevational view of the combination pen and tool arrangement according to the present invention showing the tools received in the tool holder inside the upper penholder.
Figure 9:
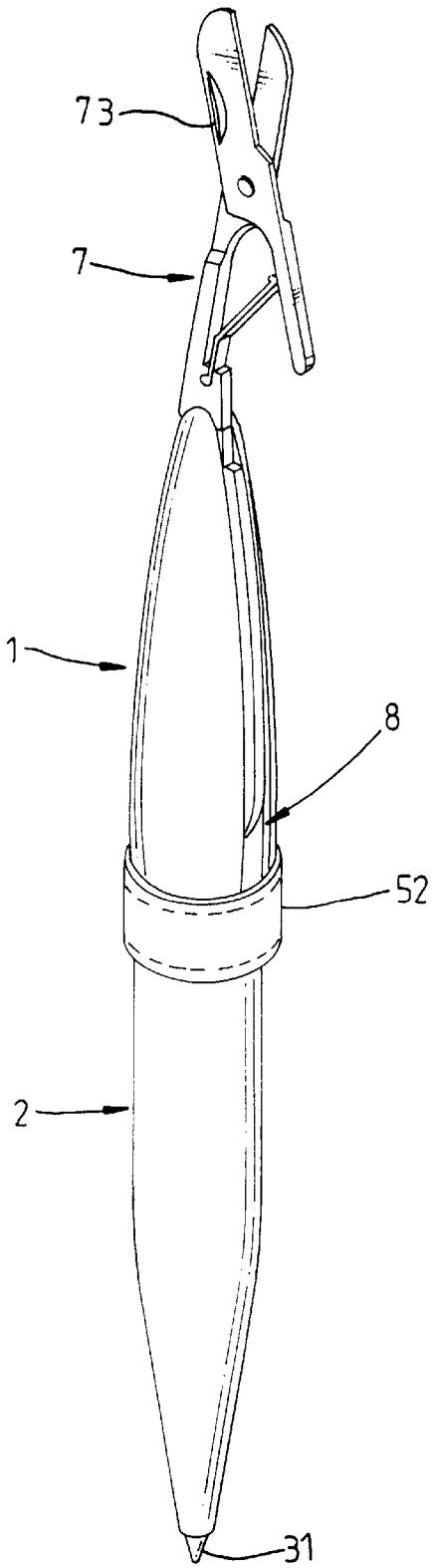
FIG. 9 is an elevational view of the combination pen and tool arrangement according to the present invention showing the scissors extended out of the tool holder and the upper penholder.
Figure 10:
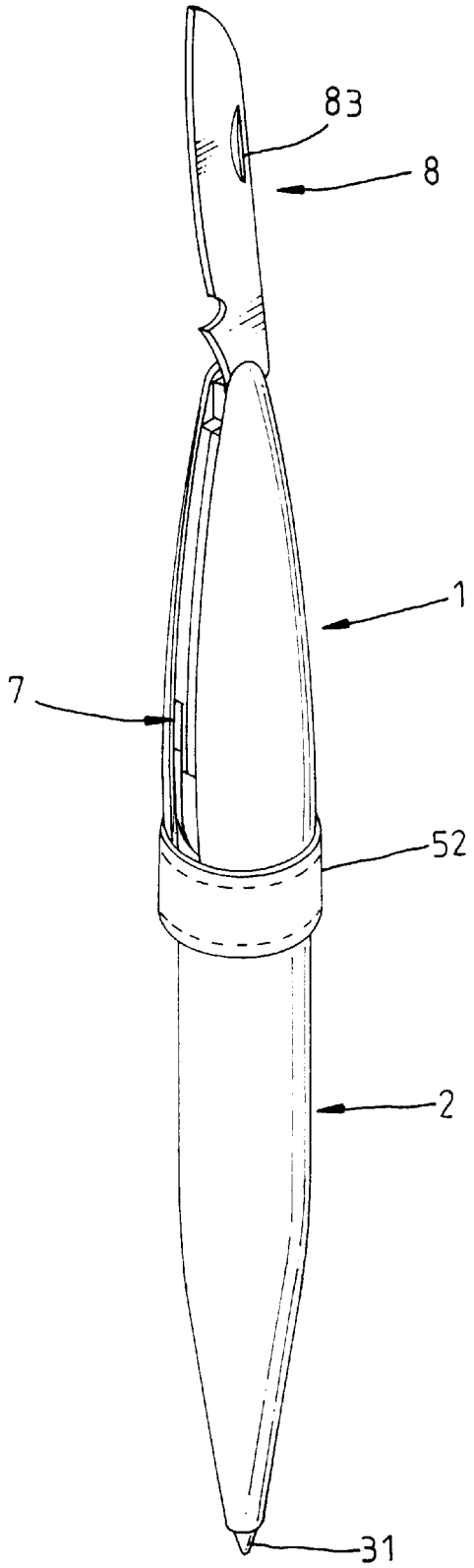
FIG. 10 is an elevational view of the combination pen and tool arrangement according to the present invention showing the cutter extended out of the tool holder and the upper penholder.
Figure 11:
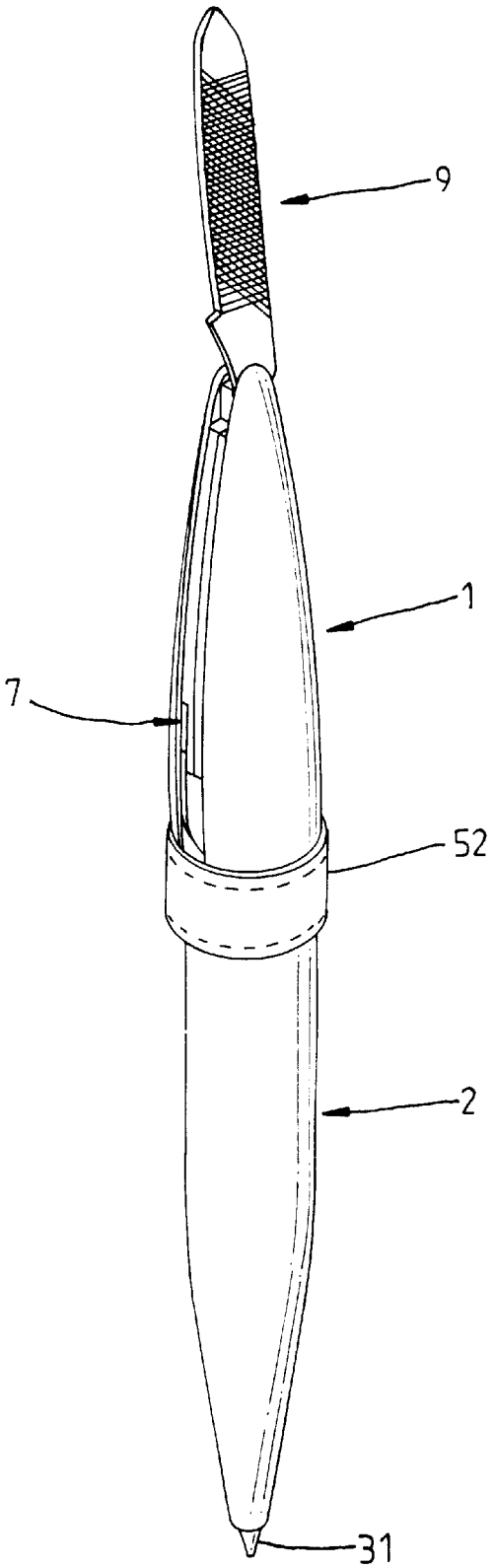
FIG. 11 is an elevational view of an alternate form of the present invention, showing a nail file used and extended out of the tool holder and the upper penholder.
Figure 12:
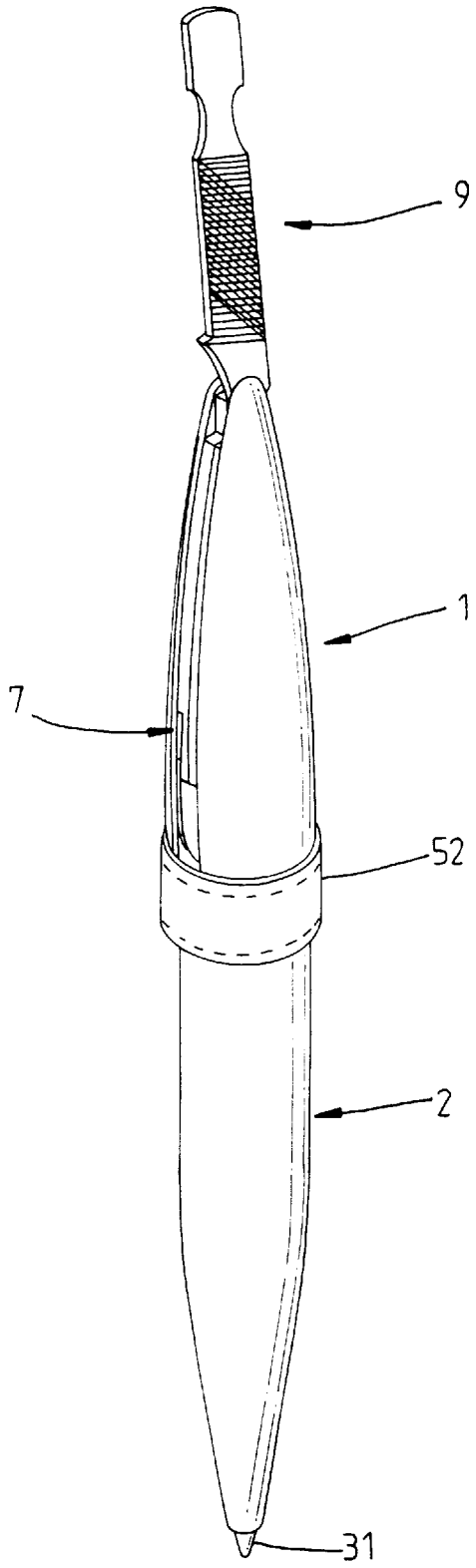
FIG. 12 is an elevational view of an alternate form of the present invention, showing another form of nail file used and extended out of the tool holder and the upper penholder.

The scissors 7 and the cutter 8 can be respectively turned about the first pivot 61 between the extended position where the scissors 7 and/or the cutter 8 are disposed outside the upper penholder 1 and the positioning notch 701 or 801 is forced into engagement with the top end 711 or 721 of the spring rod 71 or 72 (see FIGS. 2, 3, 4, 5, 9 and 10), and the received position (see FIGS. 6, 7 and 8) where the scissors 7 and/or the cutter 8 is/are received in the tool holder 4 inside the upper penholder 1. Through the finger groove 73 or 83, the scissors 7 or the cutter 8 can easily be pulled out of the tool holder 4 and the upper penholder 1 with the finger.

The binding ring 52 is sleeved onto the lower end 12 of the upper penholder 1 and the head 51 of the ink cartridge holder cap 5, and stamped to deform and to fixedly secure the upper penholder 1 to the head 51 of the ink cartridge holder cap 5, keeping the bottom end 44 of the tool holder 4 stopped at the top 50 of the head 51 of the ink cartridge holder cap 5 and secured to the inside of the upper penholder 1.

Referring to FIGS, 11 and 12, a nail file 9 may be installed in the tool holder 4 instead of the aforesaid cutter 8 (see also FIG. 1).

While only one embodiment of the present invention has been shown and described, it will be understood that various modifications and changes could be made thereunto without departing from the spirit and scope of the invention disclosed. For example, the binding ring 52 can be eliminated and, the upper penholder 1 and the tool holder 4 can be directly adhered to the head 51 of the ink cartridge holder cap 5 by adhesive; a screwdriver or any of a variety of small hand tools can be used instead of the scissors 7 or the cutter 8.

What is claimed is:

1. A combination pen and tool arrangement comprising a lower penholder, said lower penholder having an ink cartridge holder cap fastened to a top end thereof to hold an ink cartridge on the inside for writing;

an upper penholder fastened to said ink cartridge holder cap outside said lower penholder, said upper penholder comprising a longitudinal slot;

a plastic tool holder mounted inside said upper penholder, said tool holder comprising a longitudinal slot corresponding to the longitudinal slot of said upper penholder; and at least one tool pivoted to said plastic tool holder and turned in and out of said tool holder and said upper penholder through the longitudinal slot of said tool holder and the longitudinal slot of said upper penholder.

2. The combination pen and tool arrangement of claim 1 further comprising a binding ring fastened to said upper penholder and said ink cartridge holder cap to secure said upper penholder to said lower penholder.

3. The combination pen and tool arrangement of claim 1 wherein said tool holder comprises a first pivot transversely disposed near a top end thereof, a second pivot transversely disposed near a bottom end thereof, and at least one spring rod mounted on the inside, said at least one spring rod having a bottom end pivoted to said second pivot and a top end stopped between said first pivot and an inside wall of said tool holder; said at least one tool has a bottom end pivoted to said first pivot and a bottom positioning notch adapted for engaging the top end of one of said at least one spring rod when the respective tool is turned out of said tool holder and said upper penholder.

4. The combination pen and tool arrangement of claim 1 wherein said at least one tool includes a pair of scissors and a cutter.

5. The combination pen and tool arrangement of claim 1 wherein said at least one tool includes a pair of scissors and a nail file.

6. The combination pen and tool arrangement of claim 1 wherein said at least one tool includes a pair of scissors and a screwdriver.

* * * * *